US008353109B2

(12) United States Patent
Rohrbach

(10) Patent No.: US 8,353,109 B2
(45) Date of Patent: Jan. 15, 2013

(54) KNIFE

(75) Inventor: Martin Rohrbach, Horn (DE)

(73) Assignee: Martor KG, Bad Solingen (DE)

( * ) Notice: Subject to any disclaimer, the term of this patent is extended or adjusted under 35 U.S.C. 154(b) by 366 days.

(21) Appl. No.: 12/423,362

(22) Filed: Apr. 14, 2009

(65) Prior Publication Data

US 2009/0260235 A1 Oct. 22, 2009

(30) Foreign Application Priority Data

Apr. 17, 2008 (DE) ..... 10 2008 019 441

(51) Int. Cl.
*B26B 3/06* (2006.01)
*B26B 1/00* (2006.01)
*B26B 1/08* (2006.01)

(52) U.S. Cl. ..... 30/162; 30/151; 30/154; 30/164; 30/335

(58) Field of Classification Search ..... 30/154, 30/162, 164, 335, 337, 156, 151, 336, 158–161, 30/2

See application file for complete search history.

(56) References Cited

U.S. PATENT DOCUMENTS

| | | | | | |
|---|---|---|---|---|---|
| 2,578,801 | A | * | 12/1951 | Harshberger | 475/197 |
| 3,107,426 | A | | 10/1963 | Robinson, Jr. | |
| 3,176,395 | A | * | 4/1965 | Warner et al. | 30/154 |
| 3,802,080 | A | * | 4/1974 | Peter | 30/377 |
| 3,906,627 | A | | 9/1975 | Manning | |
| 3,999,290 | A | | 12/1976 | Wood | |
| 4,011,657 | A | | 3/1977 | Vance | |
| 4,068,375 | A | | 1/1978 | Rathbun et al. | |
| 4,094,217 | A | | 6/1978 | Exline | |
| 4,103,421 | A | | 8/1978 | Quenot | |
| 4,281,458 | A | | 8/1981 | Okada | |
| 4,301,594 | A | | 11/1981 | Okada | |
| 4,320,576 | A | | 3/1982 | Beermann | |
| 4,683,656 | A | * | 8/1987 | Peyrot et al. | 30/162 |
| 4,713,885 | A | * | 12/1987 | Keklak et al. | 30/162 |
| 4,805,304 | A | | 2/1989 | Knoop | |
| 4,835,865 | A | | 6/1989 | Knoop | |
| 4,899,443 | A | | 2/1990 | Beermann | |
| 5,101,564 | A | * | 4/1992 | Melter | 30/319 |
| 5,203,085 | A | * | 4/1993 | Berns | 30/163 |
| 5,269,063 | A | | 12/1993 | Okada | |
| D347,563 | S | | 6/1994 | Okada | |
| 5,355,588 | A | * | 10/1994 | Brandenburg et al. | 30/319 |
| 5,406,707 | A | | 4/1995 | Owens et al. | |

(Continued)

FOREIGN PATENT DOCUMENTS

| | | |
|---|---|---|
| DE | 43 15 495 | 11/1994 |

*Primary Examiner* — Stephen Choi
*Assistant Examiner* — Samuel A Davies
(74) *Attorney, Agent, or Firm* — Andrew Wilford

(57) ABSTRACT

A knife has a housing, a blade carrier supported in the housing and adapted to hold a blade, and an actuating element coupled to the blade carrier. A handle can move between a nonactuated position and an actuated position and is coupled to the actuating element such that on movement from the nonactuated position to the actuated position the actuating element displaces the blade carrier from a safety position in which blade mounted on the blade carrier is retracted into a seat of the housing in a first cutting position in which the blade projects out of the housing. A pivot joint connects the actuating element with the blade carrier. A guide supports the blade carrier in a translatory and a rotatable manner on the housing.

20 Claims, 6 Drawing Sheets

U.S. PATENT DOCUMENTS 5,461,786 A * 10/1995 Miller ..... 30/161
5,617,635 A 4/1997 Berns
D386,959 S 12/1997 Okada
D392,173 S 3/1998 Okada
D398,829 S 9/1998 Okada
D399,114 S 10/1998 Okada
D412,274 S 7/1999 Okada
6,044,562 A 4/2000 Dillenbeck
D431,170 S 9/2000 Okada
6,148,520 A * 11/2000 Berns ..... 30/2
6,189,218 B1 * 2/2001 Okada ..... 30/162
6,233,832 B1 5/2001 Berns
D443,494 S 6/2001 Okada
D443,807 S 6/2001 Okada
D445,660 S 7/2001 Okada
D447,400 S 9/2001 Okada
6,550,144 B1 4/2003 Berns
6,553,673 B2 * 4/2003 Peyrot et al. ..... 30/162
6,775,911 B2 * 8/2004 Tremblay ..... 30/162
6,785,966 B2 9/2004 Berns
7,127,819 B1 * 10/2006 Huang ..... 30/92
7,185,435 B1 * 3/2007 Tseng ..... 30/152
7,204,023 B2 * 4/2007 Chang ..... 30/319
7,356,928 B2 * 4/2008 Votolato ..... 30/2
2002/0029482 A1 3/2002 Peyrot et al.
2003/0019109 A1 * 1/2003 Tremblay ..... 30/162
2003/0024123 A1 * 2/2003 Liao ..... 30/162
2004/0187318 A1 * 9/2004 Mathieu et al. ..... 30/319
2004/0237312 A1 * 12/2004 Hernandez et al. ..... 30/162
2005/0086811 A1 * 4/2005 Kawasaki ..... 30/162
2006/0130340 A1 * 6/2006 Berns ..... 30/162
2007/0028455 A1 * 2/2007 Ranieri et al. ..... 30/162
2007/0074402 A1 * 4/2007 Hernandez et al. ..... 30/162
2008/0083119 A1 * 4/2008 Schmidt ..... 30/162
2008/0086896 A1 * 4/2008 McHenry et al. ..... 30/162
2008/0163493 A1 * 7/2008 Votolato ..... 30/154
2008/0250651 A1 * 10/2008 Davis et al. ..... 30/162
2009/0106983 A1 * 4/2009 Berns ..... 30/162
2009/0172889 A1 * 7/2009 Votolato ..... 7/158
2010/0043235 A1 * 2/2010 Hao ..... 30/162
2010/0319200 A1 * 12/2010 Davis et al. ..... 30/162
2011/0010947 A1 * 1/2011 Freeman ..... 30/159
2011/0119925 A1 * 5/2011 Rohrbach ..... 30/158

* cited by examiner

KNIFE

FIELD OF THE INVENTION

The invention relates to a knife with a housing and a blade carrier supported in the housing with an actuating device having at least one actuating element and at least one handle.

BACKGROUND OF THE INVENTION

Such a knife is known from U.S. Pat. No. 4,713,885. Here, the knife has a blade carrier which is mounted displaceable in a translatory manner within a knife housing and which is moveable between a rear position and a front position by means of a handle. The handle is formed by a lever which is pivotably attached to the housing by means of a joint. Further, a toggle mechanism is pivotably attached to the housing with one end and is pivotably attached to the blade carrier with the other end. The pin joint of the toggle mechanism is guided in an elongated hole of the handle.

The knife is in need of improvement in particular with respect to its safety.

OBJECT OF THE INVENTION

It is the object of the invention to provide a knife which is further improved with respect to its safety as well as to its manufacturability and its functionality. It is further the object of the invention to provide a knife which allows a compact construction.

SUMMARY OF THE INVENTION

The object is solved according to a first aspect of the invention in that the blade carrier is movable by means of an actuating device from a safety position, in which the blade is retracted into the housing and inaccessible for the user, into a cutting position in which the blade projects out of the knife housing. The blade carrier is supported in a translatory and rotatably moveable manner. By means of the rotatably moveable support, the region of the actuating device which interacts with the blade carrier can carry out a complex movement into the cutting position which for example has movement components in two space directions. This can concern, for example a combined movement consisting of a pivoting movement and a translatory movement. The region of the actuating element which interacts with the blade carrier is hence not limited to a linear movement as this was the case for the prior art. The actuating element can carry out, for example a pivoting movement, wherein the blade carrier interacting with the actuating element carries out a pivoting movement and a linear movement.

The actuating element can be formed, for example by means of an actuating lever which interacts with the blade carrier. The blade carrier is pivotable relative to the actuating lever. During the movement between the starting position and the first pivot position, the actuating lever carries out a pivoting movement with a certain pivot angle, thereby moving the blade carrier from the safety position and into the first cutting position.

The actuating device comprises at least one actuating element as well as a handle. The actuating element, for example is moveable by means of the handle from a starting position into a first pivot position. The handle is moved, for example from a nonactuated position into an actuated position so as to move the actuating element from the starting position into a first pivot position.

The actuating element is supported within the housing. It can be supported indirectly or directly within the housing. By means of the handle, the actuating element, for example can be actuated indirectly or directly. The handle and the actuating element can be formed, for example from separate parts. Alternatively, for example the handle and the actuating element can be formed from one component. The handle, for example can form one region of the actuating element. The actuating element, for example can be supported at the housing. The handle, for example can form a part of the housing. The actuating element, for example can be supported at the handle.

According to the invention, the actuating element interacts with the blade carrier in a pivotably-jointed manner. The actuating element, for example can be fixed connected with the blade carrier. Alternatively, the actuating element, for example can be detachably connected to the blade carrier. In the connected state, the blade carrier and the actuating element can then be pivoted relative to one another.

The blade carrier is supported in a translatory moveable and/or rotatably moveable manner at the housing. "Translatory moveable", according to the invention, means that the blade carrier is moveable along a linear path. The path, for example can have at least one curve.

The advantage of the invention consists in the fact that the knife comprises few parts only and that a simple construction is possible. In this manner, the knife can be manufactured in a simple manner and causes low manufacturing costs. In addition, the knife according to the invention has a high functional safety.

The object set above is solved according to a second aspect of the invention by means of a knife with the features of the claim 2.

The principle of the invention consists in providing a support element which is assigned to the actuating element or the housing. By means of the support element, the actuating element can be supported at the housing in a detachable manner. During the movement of the actuating element from the starting position into a first position, the support element, for example can be engaged with the housing or can be moved in engagement with the housing. Then, for example the support element limits the degree of freedom of the actuating element so that the actuating element is forced into the first pivot position. The support element, for example can form a support about which the actuating element can be pivoted. When the blade carrier is moved, for example by means of a cutting reaction force from the first cutting position into the second cutting position, the support element thereby can be moved out of engagement. The actuating element has then again an additional degree of freedom which allows the actuating element to move back into the housing even with the handle being actuated.

The advantage of the knife according to the invention consists in the fact that by means of the support element, a certain movement can be predetermined for the actuating element. By means of the support element, a distance between the actuating element and the housing can be bridged. In addition, by means of the support element, a safety function can be ensured, wherein the blade, with actuated handle, moves back into the housing into the safety position when the cutting reaction force on the blade falls below a certain value.

According to a first embodiment, the actuating element is formed as a lever which is connected with a part of the housing in a pivotably moveable manner. The actuating element can be supported at a movable part of the knife. For example, the actuating element can be supported at the handle. The actuating element can be pivoted from a starting position into a first pivot position when the handle is moved from the nonactuated position in an actuated position.

According to a further embodiment, the actuating element is fixed connected to the blade carrier by means of a pivot joint. The blade carrier is moveably connected to the actuating element. The blade carrier and the actuating element can take different angle positions with respect to one another. According to a further embodiment, the handle is assigned to the actuating element. The handle can be integrally formed with the second end. The handle, for example can be formed by a region of the actuating lever. Alternatively, the handle can be formed, for example as a separate component and can interact with the actuating element. The handle, for example can interact detachably with the actuating element. A first end of the actuating element, for example can be connected to the blade carrier and a second end of the actuating element can be connected to the handle.

According to a further design of the invention, the actuating element is fixed connected to the handle. The actuating element, for example can be fixed connected to the handle by means of a joint. The actuating element, for example can be pivotably hinged to the handle. When moving the handle from the nonactuated position into the actuated position, the actuating element which is movably connected to the handle is moved on this movement path as well.

According to a further embodiment, the handle is formed by a lever which is pivotably hinged to the housing, wherein the handle is pivotable at least between an actuated position and a nonactuated position. In this manner, the handle can be pivoted tong-like relative to the housing, wherein the actuating element, for example is moved from a starting position into a first pivot position.

According to a further embodiment, the handle is biased by a spring into the nonactuated position. The handle is then automatically moved into the nonactuated position as soon as the user does not apply force any more on the handle.

According to a further embodiment, a support element is provided for the actuating lever, which said support element is assigned to the actuating element or the housing and by means of which the actuating element is supported at the housing in at least the first cutting position. The support element can limit the degree of freedom of the actuating element. It can form a support about which the actuating element can pivot in a rocker-like manner. The support element, for example can be attached to the actuating element and can be brought at least indirectly in engagement with the housing. The support element can interact, for example with an abutment element which is attached to the housing. Alternatively, the support element, for example can be attached to the housing and can be brought in engagement with the actuating element. At the actuating element, for example an abutment element can be provided which interacts with the support element.

According to a further embodiment, an abutment is provided which is fixed to the housing and by which the actuating element is supported. By means of the abutment, the actuating element can be forced to follow a certain movement path. By means of the abutment, by moving the handle from a nonactuated position into an actuated position, the actuating element can be moved from a starting position into a first pivot position in which the blade carrier is arranged in the cutting position and projects out of the housing. The abutment, for example can be integrally formed on the housing. The abutment, for example can interact with the support element which, for example is attached to the actuating element.

According to a further embodiment, the support element can be engaged detachable with the housing or the actuating element. By means of this embodiment, the degree of freedom of the actuating lever can be limited upon engagement of the support element in a certain manner and can be released again by detaching the support element. The actuating element, for example can move back toward the starting position when the engagement of the support element is released, regardless of whether the handle is in the actuated position. The blade carrier which is movably connected to the actuating element can move into the safety position when the actuating lever moves toward the starting position.

According to a further embodiment, the support element can be engaged with the housing or the actuating element only by pressure. The engagement of the support element with the housing or the actuating element can be released in this embodiment in a simple manner. The disengagement of the support element can be carried out, for example by means of a pivoting movement of the actuating lever.

According to a further embodiment, the support element is formed approximately rod-shaped. By means of the rod shape, for example a distance between the actuating element and the housing can be bridged.

According to a further embodiment, the support element is pivotably connected to the actuating element. Due to the pivotable mounting of the support lever at the actuating element, the actuating element can pivot, for example in a rocker-like manner about the support element when the support element is engaged with the housing. When the support element is moved to be disengaged with the housing, it can be pivoted into a position in which an undesired re-engagement with the housing is prevented as long as the handle is in the actuated position.

According to a further embodiment, at the housing or at the actuating element, a bearing seat is formed with which the support element can be engaged detachably. The bearing seat, for example can be formed by a recess, for example by a groove by means of which an unintended disengagement of the actuating element is prevented. During the movement of the actuating element from the starting position into the first pivot position, the support element can be arranged within the groove. During the movement of the actuating element from the first pivot position into the second pivot position, the support element can move out of the groove and, in this manner, can lose the contact to the housing or to the actuating element.

According to a further embodiment, adjacent to the recess, at least one guide face is formed which guides the support element in engagement with the recess. For example, two guide faces can be provided, wherein a first guide face guides the support element during the movement of the actuating element into the first pivot position into the recess. After the support element has disengaged from the recess, the actuating element, for example can move back with the actuated handle toward the starting position. In doing so, the support element, for example can abut against the second guide face which guides the support element to the first guide face.

According to a further development of the invention, the support element is biased by at least one spring into a neutral position. When pivoting the support element in at least one rotational direction, the support element is then biased back into the neutral position. When the actuating element after engagement of the support element is moved by means of the abutment element into the first pivot position, the support element can pivot at the same time relative to the actuating element and can tension the spring. The spring, for example can be formed by a tension spring, or a compression spring, or by another suitable spring. The spring, for example can be integrally formed at the actuating element and can be formed as one piece with the same.

According to a further embodiment, the blade carrier is supported in a translatory moveable and/or rotatably moveable manner at the housing. The blade carrier can be provided, e.g. with at least one guide element which corresponds with a guide structure of the housing. The guide element, for example can be formed by a truncated cylinder which is received in a guide groove formed within the housing.

According to a further embodiment, the blade carrier is moveable from the safety position into a first cutting position in which the blade projects out of the housing, and is moveable by means of an additional movement from the first cutting position into at least a second cutting position. From the second cutting position, the blade carrier is moveable back into the safety position. To the different positions of the blade carrier, positions of the actuating element and the support element can be assigned. For example, by means of the movement from the first cutting position into the second cutting position, a movement of the actuating element and/or the support element can be controlled. The movement of the blade carrier from the first into the second cutting position can be carried out, for example by means of the cutting force acting on the blade during the cut when the blade is moved into the material to be cut. Between the safety position and the first cutting position, the actuating element can be supported, for example by means of the support element at the housing. By means of the movement into the second cutting position, the support element, for example can move out of the engagement with the housing or the actuating element.

According to a further development of the invention, the support element is engaged when the blade carrier is moved into the first cutting position and the support element is disengaged when the blade carrier is moved into the second cutting position, wherein, with the handle moved into the actuated position, a movement of the blade carrier into the safety position is prevented when the support element is engaged, and a movement of the blade carrier into the safety position is possible when the support element is disengaged. By means of the movement of the blade carrier from the first into the second cutting position, for example the actuating element can be moved from a first pivot position into a second pivot position. By means of the movement of the actuating element into the second pivot position, for example the support element can be moved out of the engagement with the housing or with the actuating element.

According to a further embodiment, the blade carrier is supported in such a manner that a cutting force acting on the blade causes a translatory movement and/or a pivoting movement of the blade carrier, wherein the blade carrier is moved from the first cutting position into the second cutting position. By means of the translatory movement and/or the pivoting movement of the blade carrier, the actuating element, for example is moved from the first pivot position into the second pivot position.

The object set above has been solved according to a third aspect of the invention with the features of the claim 19.

The principle of the invention is that the seat is commonly formed by a housing shell of the knife and the handle. The seat of the housing and the seat of the handle are connected with one another. The housing shell and the handle, for example form the housing of the knife. For example, the actuating element can be arranged at least in part within the seat of the handle. A spring loading the actuating element into the starting position can be arranged, for example within the seat of the handle.

The advantage of the invention is that the construction of the knife can be designed flexible since an additional seat is available in which functional parts of the knife can be received.

BRIEF DESCRIPTION OF THE DRAWING

Further advantages are apparent by means of the subclaims not mentioned above and by means of the description of an exemplary embodiment shown in the following figures. In the figures.

A knife as a whole is denoted in the figures with the reference number 10. The same reference numbers in the different is figures denote corresponding parts with the addition of lower-case letters.

Figure 1:
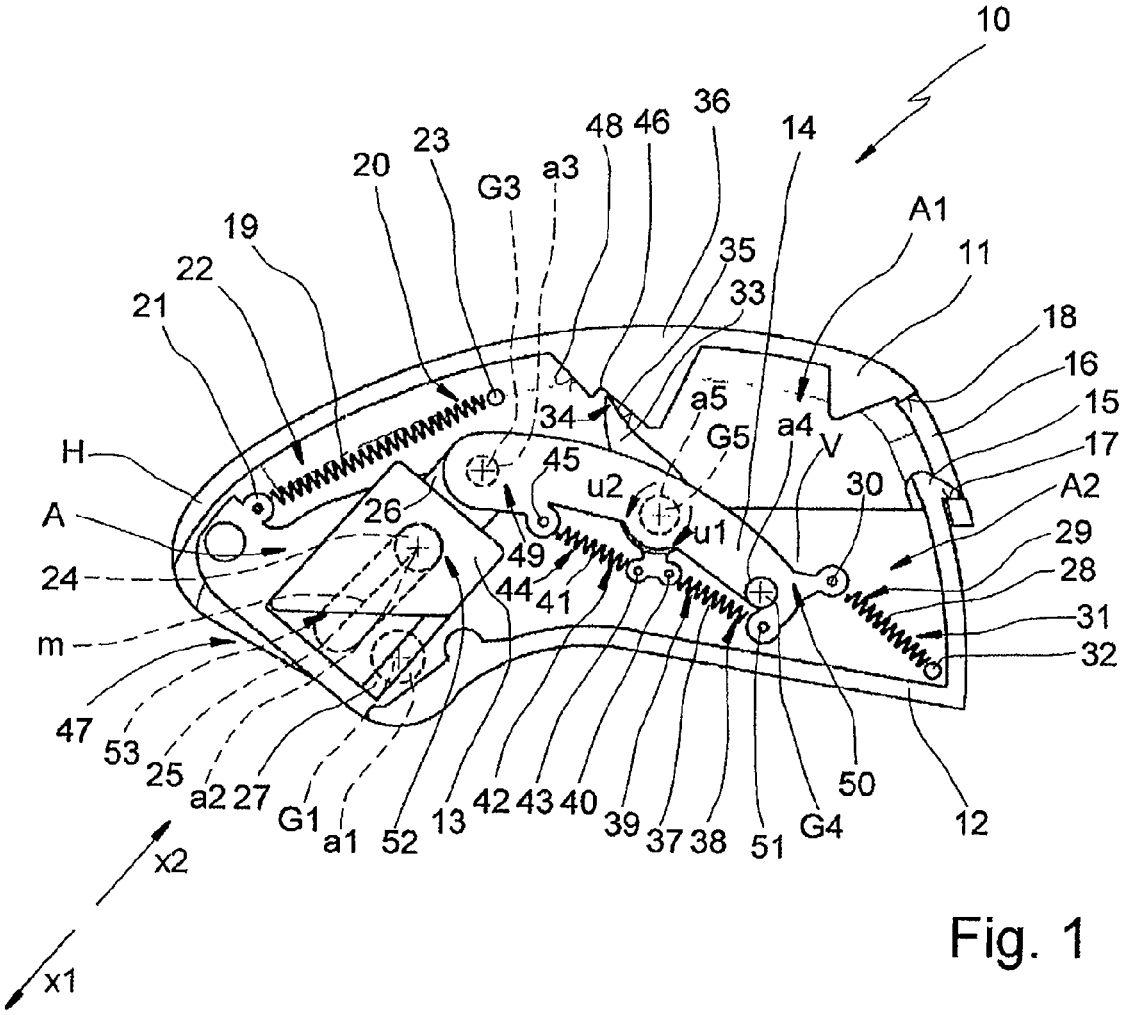
FIG. 1 is a schematic partial sectional view of the knife where the blade carrier is in the safety position and the handle is in the nonactuated position.

The knife 10 includes a housing H, a handle 12, a blade carrier 13, and an actuating element 14. The handle 12 and the actuating element 14 are parts of an actuating device V. The housing H is formed by a housing shell 11 and the handle 12.

The handle 12 is pivotal on the housing shell 11 at a pivot joint G1 with a pivot axis a1. The handle 12 is moveable between a nonactuated position according to FIG. 1 and an actuated position according to the FIGS. 2, 3 and 4. The handle 12 comprises an abutment element 15 which is received in a slot-like recess 16 of the housing shell 11. In the nonactuated position, the abutment element 15 interacts with an end 17 of the recess 16, and in the actuated position with an opposite end 18 of the recess 16. The end 17 and the end 18 each form an abutment for the abutment element 15. The movement of the handle 12 is limited in this manner.

The handle 12 is biased by a spring 19 into the nonactuated position. An end 22 of the spring 19 is connected to a mount 21 integrally formed on the handle 12. Another end 20 of the spring 19 is mounted on a retaining bolt 23 integrally formed on the housing shell 11.

Within the housing shell 11, a seat A1 is formed in which the blade carrier 13 is arranged. Within the handle 12, a seat A2 is formed. The seats A1 and A2 are connected with one another and together form the seat A. On the blade carrier 13, a truncated cylinder 24 is integrally formed which is received in a groove 25 of the handle 12. In this manner, the blade carrier 13 is displaceable parallel to a longitudinal center axis m of the groove 25 in the directions x1 and x2 and is pivotable about an axis a2 of the bolt 24. The blade carrier 13 can be moved between a safety position (see FIG. 1), a first cutting position (see FIG. 2), and a second cutting position (see FIG. 3). The blade carrier 13 has a holder for a blade 27, which holder is not is shown in detail here.

In the safety position, the blade carrier 13 is positioned such that the blade 27 is retracted into the housing H and is inaccessible for a user. In the first cutting position and in the second cutting position, the blade 27 projects out of the housing H.

A rear extension 26 of the blade carrier 13 is fixed to a first end 49 of the actuating element 14 by means of a joint G3 with a pivot axis a3. The blade carrier 13 is pivotable relative to the actuating element 14 by means of the joint G3. The actuating element 14 and the blade carrier 13 are moveably connected to one another.

At a second end 50, the actuating element 14 is pivotably supported on the handle 12 by a joint G4 which has a pivot axis a4. A spring 28 biases the actuating element 14 into the starting position shown in FIG. 1 in which the actuating element 14 keeps the blade carrier 13 in the safety position. The spring 28 is mounted with one end 29 to the mount 30 of the actuating element 14 and with another end 31 to a mount 32 of the handle 12.

A support element 33 is pivotably mounted to the actuating element 14 by means of a pivot joint G5 with a pivot axis a5. An end 34 of the support element 33 abuts in the starting position, shown in FIG. 1, of the actuating element 14 against an outer surface 35 of a housing structure 36. The support element 33 is pivoted from a neutral position in the direction u2. A first spring 37 biases the support element 33 clockwise in an opposite rotational direction u1 against the outer surface 35. The spring 37 is connected with an end 38 to a mount 51 of the actuating element 14, and with an end 39 to a mount 40 of the support element 33.

A second spring 41 is released in the position shown in FIG. 1. The spring 41 is secured by an end 42 to a mount 43 of the support element 33, and by an end 44 to a mount 45 of the is actuating element 14.

The spring 37 and the spring 41 are formed as compression springs in the present embodiment. However, alternatively, all suitable spring s can be used.

Figure 2:
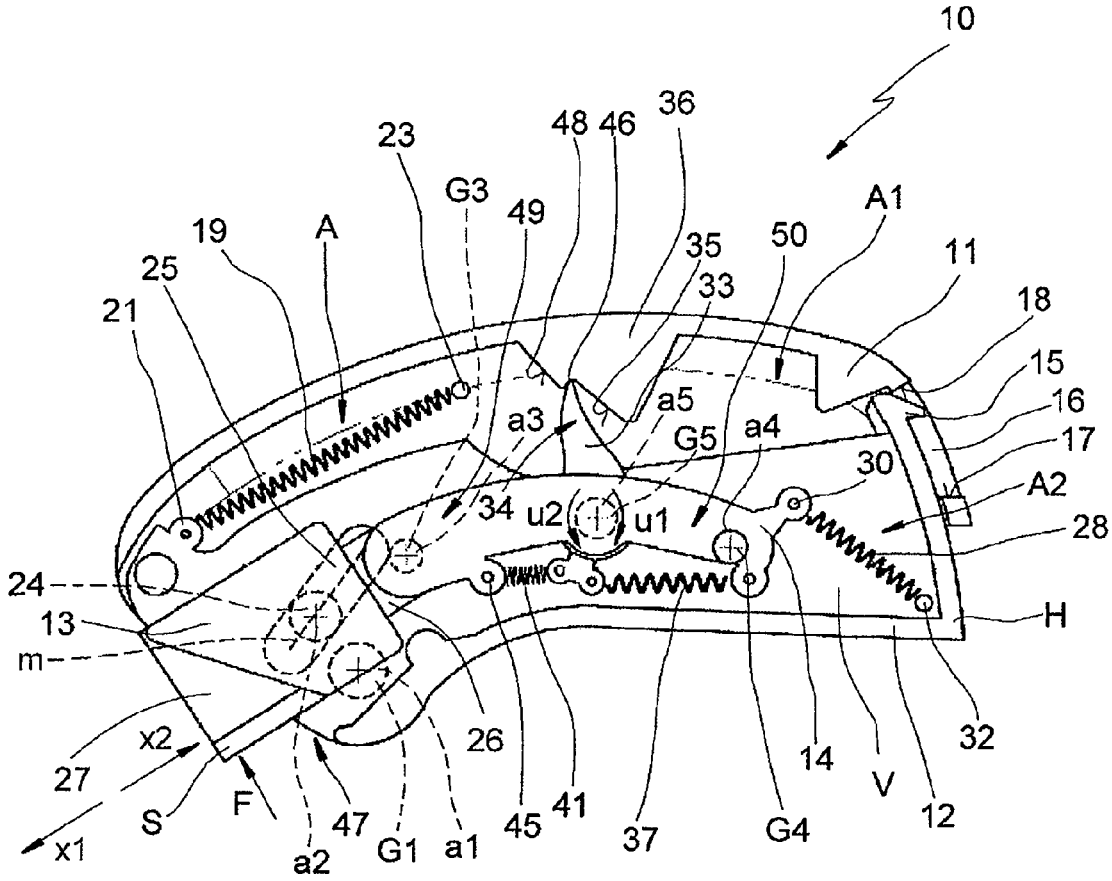
FIG. 2 is an illustration of the knife according to FIG. 1 where the blade carrier is in the first cutting position and the handle is in the actuated position.

If the handle 12 is moved from the nonactuated position according to FIG. 1 into the actuated position according to FIG. 2, then the end 34 of the support element 33 moves along the outer surface 35 into engagement with a notch 46. By means of the engagement of the support element 33 with the notch 46 when moving the handle 12 from the nonactuated position into the actuated position, the actuating element 14 is pivoted about the axis a5 in the direction u2 into the first pivot position shown in FIG. 2. After engagement of the end 34 with the notch 46 contact is made between the support element 33 and the housing shell 11, the actuating element 14 acts as a two-armed lever with the pivot axis a5, and the end 49 is a first lever arm and the end 50 is a second lever arm. Pivoting of the actuating element 14 from the starting position into the first pivot position takes place against the force of the spring 28. During movement of the actuating element 14 from the starting position into the first pivot position, the blade carrier 13 is pivoted clockwise according to FIG. 1 about the pivot axis a2. Furthermore, the blade carrier 13 is pivoted relative to the actuating element 14 about the pivot axis a3. Further, the truncated cylinder 24, which is fixed to the blade carrier 13, is moved in the groove 25 formed in the handle 12 in the direction of x1. While the truncated cylinder 24 in the safety position of the blade carrier 13 according to FIG. 1 is located at the end 52 of the groove 25, the truncated cylinder 24 in the first cutting position of the blade carrier 13 according to FIG. 2 is moved toward an end 53 of the groove 25.

If the actuating element 14 is in the first pivot position, the blade 27 projects out of an opening 47 of the knife 10. The housing shell 11 and the handle 12 have openings that form the opening 47 of the housing H. During pivoting of the actuating element 14 into the first pivot position, further, the support element 33 is pivoted relative to the actuating element 14 against the spring force of the second compression spring 41 in the rotational direction u1.

Figure 3:
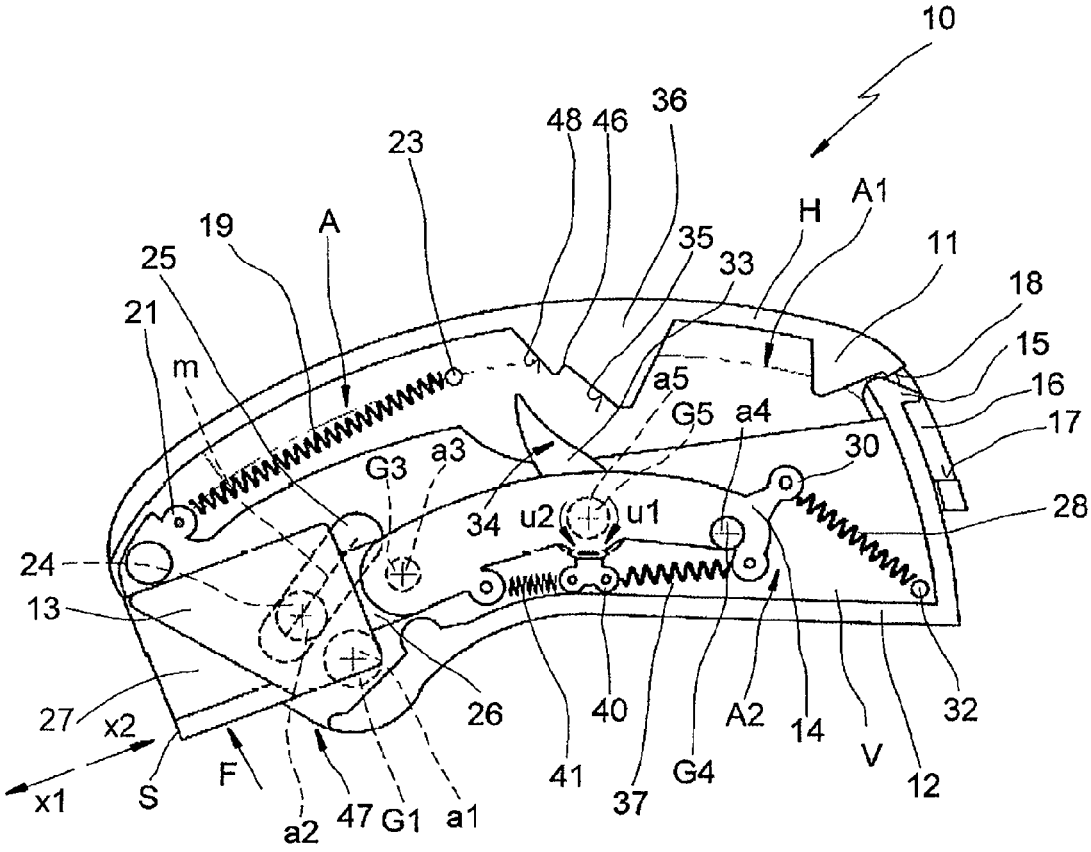
FIG. 3 is an illustration of the knife according to FIG. 2 where the blade carrier in the second cutting position and the handle is in the actuated position.

If a cutting reaction force F acts on the blade 27 in the position of the knife 10 as shown in FIG. 1, then the blade carrier 13 pivots clockwise about the pivot axis a2 from the first cutting position into the second cutting position shown in FIG. 3. The cutting reaction force applied to the blade 27 can also act on the blade 27 in a direction other than the marked direction. The cutting reaction force F can act parallel to the edge S of the blade 27 and perpendicular to the edge S.

Since the blade carrier 13 is moveably connected to the actuating element 14 by the joint G3, the actuating element 14 is moved at the same time into the second pivot position shown in FIG. 3. The support element 33 is moved by pivoting of the actuating element 14 into the second pivot position and out of engagement with the notch 46 and is moved by the second compression spring 41 relative to the actuating element 14 in the direction u2 into the neutral position shown in FIG. 3.

Figure 6A:
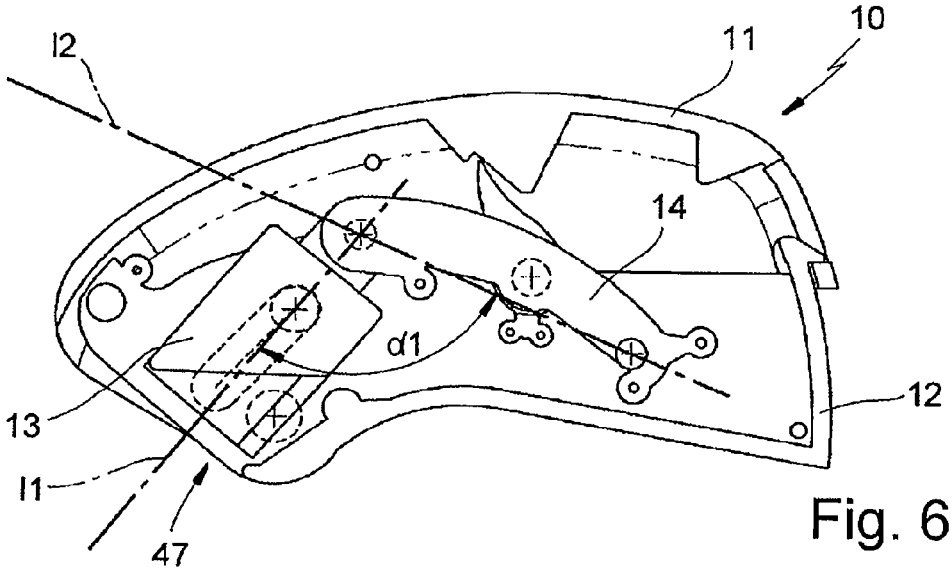
FIG. 6*a* is an illustration of the angle between the blade carrier and the actuating element according to FIG. 1 where the blade carrier is in the safety position.
Figure 6B:
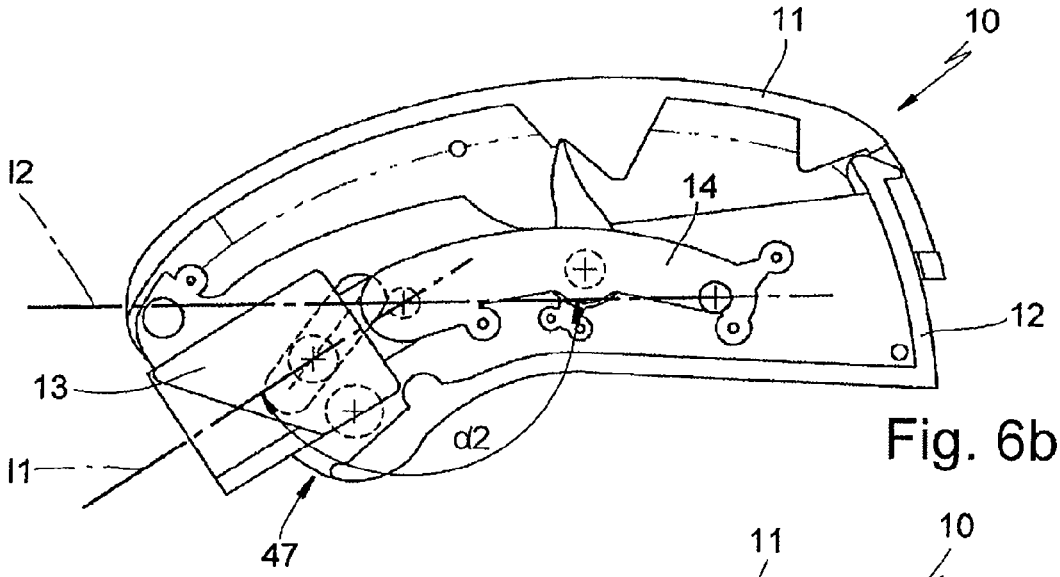
FIG. 6*b* is an illustration of the angle between the blade carrier and the actuating element according to FIG. 2 where the blade carrier is in the first cutting position.
Figure 6C:
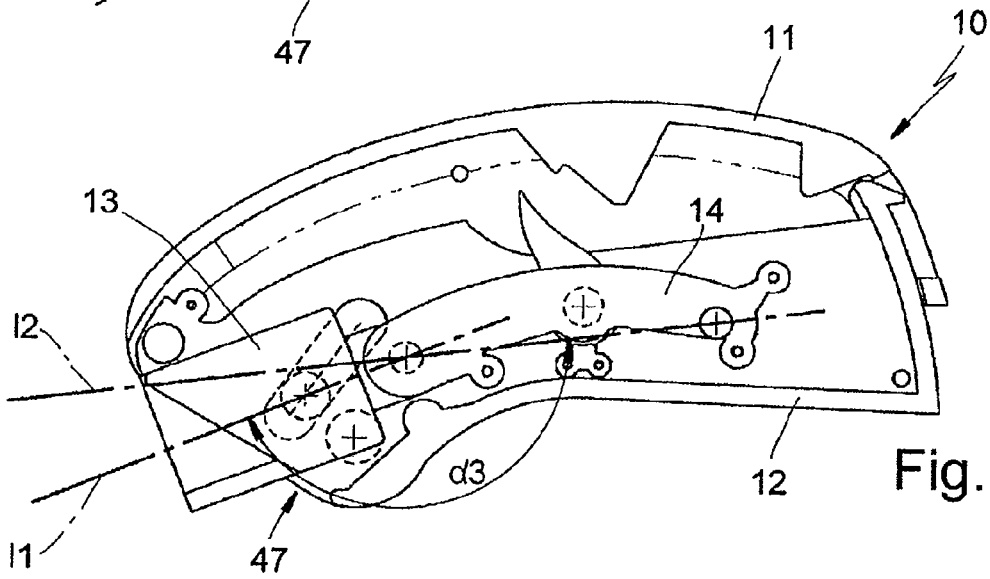
FIG. 6*c* is an illustration of the angle between the blade carrier and the actuating element according to FIG. 3 where the blade carrier is in the second cutting position.

In the starting position of the actuating element 14 (see FIG. 6*a*), a center axis 11 of the blade carrier 13 extends at an angle $\alpha 1$ with respect to a center axis 12 of the actuating element 14. In the first pivot position (see FIG. 6*b*) of the actuating element 14, the center axis 11 has an angle $\alpha 2$ with respect to the center axis 12. In the second pivot position (see FIG. 6*c*) the center axis 11 is pivoted with an angle $\alpha 3$ with respect to the center axis 12. The angle $\alpha 1$ is smaller than the angle $\alpha 2$, and the angle $\alpha 2$ is smaller than the angle $\alpha 3$.

Figure 4:
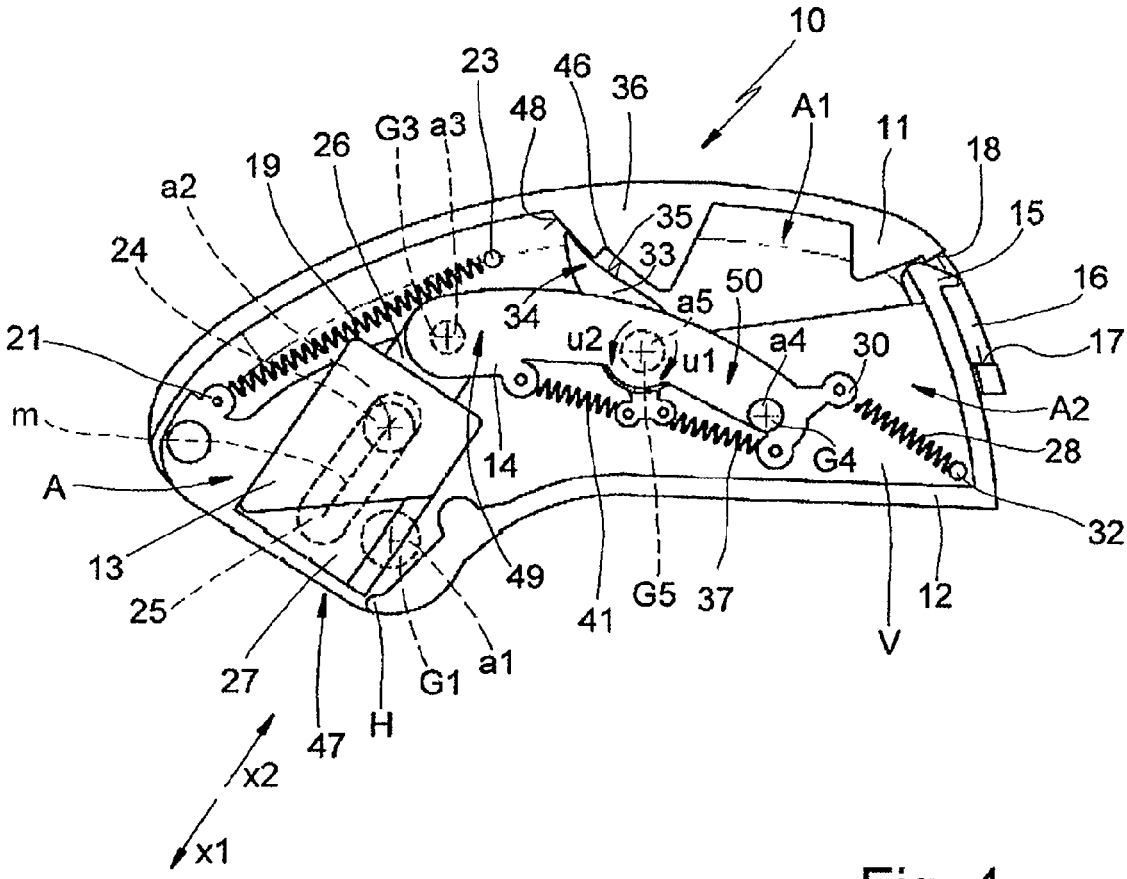
FIG. 4 is an illustration of the knife according to FIG. 3 where the blade carrier is in the safety position and the handle is in the actuated position.

As soon as the cutting force F is smaller than the force of the spring 28, which is the case, for example at decreasing contact between the blade 27 and a not-shown material to be cut, the actuating element 14 is moved by the spring 28 from the second pivot position clockwise about the pivot axis a4 into the third pivot position shown in FIG. 4, although the handle 12 is in the actuated position. In doing so, the blade carrier 13 is moved in the direction x2 into the safety position in which the blade 27 mounted to the blade carrier 13 is retracted into the seat A of the housing H. The third pivot position of the actuating element 14 differs from the starting position only by a small angle which, for example is smaller than 5°.

In the third pivot position shown in FIG. 4, the end 34 of the support 33 abuts against an outer surface 48 of the housing structure 36. The blade carrier 13 is in the safety position in which the blade 27 is retracted into the housing and inaccessible to the user. The spring 37 is tensioned and biases the support 33 against the outer surface 48 of the housing structure 36.

Figure 5:
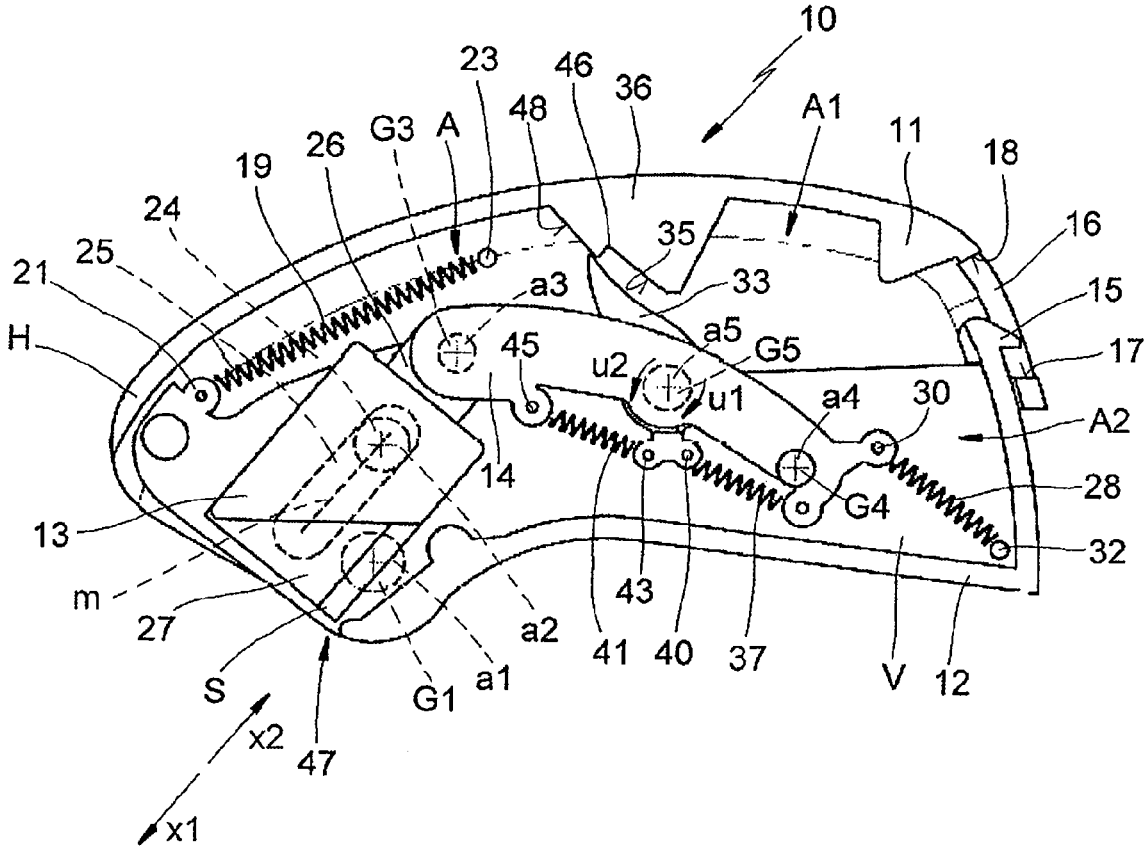
FIG. 5 is an illustration of the knife according to FIG. 4 where the blade carrier is in the safety position and the handle is between the actuated and the nonactuated position.

As soon as the user releases the handle 12, the handle 12 is pivoted by means of the spring 19 about the pivot axis a1 into the nonactuated position. In so doing, the end 34 of the support element 33 slides along the outer surface 48 and is guided by the outer surface 48 to the outer surface 35. In FIG. 5, the knife 10 is shown shortly before reaching the nonactuated position of the handle 12.

This nonactuated position of the handle is shown in FIG. 1. According to FIG. 1, the support element 33 abuts again with the end 34 against the outer surface 35.

As already mentioned above, the seat A of the knife 10 is formed by the seat A1 of the housing shell 11 and the seat A2 of the handle 12. The housing shell 11 and the handle 12 have openings which are facing each other and by means of which the seat A1 and the seat A2 are connected to one another to form the receiving room A.

The invention claimed is:

1. A knife comprising:

a housing;

a blade carrier supported within the housing and adapted to hold a blade and movable between a safety position in which the blade mounted on the blade carrier is retracted into the housing, a first cutting position in which the blade projects out of the housing, and a second cutting position offset from the first position and from the safety position;

an actuating element;

a pivot joint connecting the actuating element to the blade carrier;

a handle coupled to the actuating element and movable therewith between a nonactuated position and an actuated position such that on movement from the nonactuated position to the actuated position the actuating element displaces the blade carrier from the safety position into the first cutting position; and a support element engageable between the housing and the actuating element and bracing the actuating element against the housing on movement of the handle from the nonactuated position to the actuated position and forcing the blade carrier to move into the first cutting position, movement of the blade into the second cutting position disengaging the support element from between the actuating element and the housing and permitting the blade carrier to move from the second cutting position into the safety position with the handle in the actuated position.

2. The knife of claim 1, wherein the actuating element is formed as a lever and is pivotal on the handle.

3. The knife of claim 1, further comprising a spring urging the blade carrier into the safety position.

4. The knife of claim 1, wherein the handle is a lever pivotal on the housing between the nonactuated position and the actuated position.

5. The knife of claim 1, further comprising: a spring biasing the handle into the nonactuated position.

6. The knife of claim 1, further comprising: an abutment fixed to the housing and against which the support element is braceable.

7. The knife of claim 1, wherein the support element is detachably braced against the housing or the actuating member.

8. The knife of claim 7, wherein the support element is braceable against the housing or the actuating element only by applying pressure to the handle.

9. The knife of claim 1, wherein the support element is pivotal on the actuating element.

10. The knife of claim 1, wherein the housing is formed with a notch in which the support element is detachably engageable.

11. The knife of claim 1, further comprising:

at least one guide face formed adjacent the notch and guiding the support element into engagement with the notch

12. A knife comprising:

a housing;

a blade carrier supported within the housing and adapted to hold a blade and movable between a safety position in which the blade mounted on the blade carrier is retracted into the housing, a first cutting position in which the blade projects out of the housing, and a second cutting position offset from the first position;

an actuating element coupled to the blade carrier;

a pivot joint connecting the actuating element to the blade carrier;

a handle movable between a nonactuated position and an actuated position and coupled to the actuating element such that on movement from the nonactuated position to the actuated position the actuating element displaces the blade carrier from the safety position into the first cutting position;

guide means for supporting the blade carrier in a translatory and a rotatable manner on the housing; and a support element mounted on the actuating element or the housing so as to brace the actuating element against the housing and prevent the blade carrier from moving into the safety position when the blade carrier is moved from the safety position into the first cutting position and to disengage the actuating element from the housing and permit movement of the blade carrier into the safety position when the blade carrier is moved from the first cutting position into the second cutting position.

13. The knife of claim 12, wherein the actuating element is formed as a lever and is rotatable on the handle.

14. The knife of claim 12, wherein the handle is a lever pivotal on the housing between the nonactuated position and the actuated position.

15. The knife of claim 12, further comprising:

a spring biasing the handle into the nonactuated position.

16. The knife of claim 12, further comprising:

an abutment fixed to the housing and against which the support element is braceable.

17. The knife of claim 12, wherein the support element is detachably braced against the housing or the actuating member.

18. The knife of claim 12, wherein the support element is braceable against the housing or the actuating element only by applying pressure to the handle.

19. The knife of claim 12, wherein the support element is pivotal on the actuating element.

20. The knife of claim 12, wherein the housing or the actuating element is formed with a notch in which the support element is detachably engageable, the knife further comprising:

at least one guide face formed adjacent the notch and guiding the support element into engagement with the notch.

* * * * *